US006957984B1

(12) United States Patent
Huang

(10) Patent No.: US 6,957,984 B1
(45) Date of Patent: Oct. 25, 2005

(54) ERRORPROOF DEVICE IN COMBINATION WITH A MODULAR SOCKET

(76) Inventor: Huang-Chou Huang, No. 59, Sec. 1, Jiow Juang St., Nankang Dist., Taipei (TW)

( * ) Notice: Subject to any disclaimer, the term of this patent is extended or adjusted under 35 U.S.C. 154(b) by 0 days.

(21) Appl. No.: 10/973,676

(22) Filed: Oct. 26, 2004

(51) Int. Cl.[7] ..... H01R 13/64
(52) U.S. Cl. ..... 439/676; 439/677
(58) Field of Search ..... 439/674, 676, 439/677, 680, 681

(56) References Cited

U.S. PATENT DOCUMENTS 6,257,935 B1 * 7/2001 Zhang et al. ..... 439/680
6,273,761 B1 * 8/2001 Hsu et al. ..... 439/676
6,283,796 B1 * 9/2001 Yeh ..... 439/677
6,319,070 B1 * 11/2001 Tan ..... 439/680
6,350,157 B1 * 2/2002 Mizusawa ..... 439/676
2004/0224565 A1 * 11/2004 Wan et al. ..... 439/680

* cited by examiner

*Primary Examiner*—Tho D. Ta
(74) *Attorney, Agent, or Firm*—Jackson Walker, LLP

(57) ABSTRACT

A modular socket for use with a modular plug includes a body having a through hole for receiving a modular plug and two opposed slots each defined in a side face of the body, an errorproof device pivotally received in the body and having two arms respectively extending out to be inserted into a corresponding one of the two slots, each arm having a step formed on an inner face of the arm for prevention of an erroneous insertion of the modular plug of a dimension smaller than a distance between the two steps, a recovery force providing device securely engaged with the errorproof device to provide a recovery force to the errorproof device when the errorproof device is pivoted and a casing securely mounted outside the body to prevent separation of the errorproof device and the recovery force providing device from the body.

9 Claims, 4 Drawing Sheets

ERRORPROOF DEVICE IN COMBINATION WITH A MODULAR SOCKET

BACKGROUND OF THE INVENTION

1. Field of the Invention

The present invention relates to an errorproof device, and more particularly to the combination of an errorproof device and a modular socket.

2. Description of Related Art

A conventional communication modular socket for connection with a modular plug used in a telephone line or a modem does not have the ability to distinguish whether the plug to be inserted into the socket has the appropriate dimension. For example, the currently available RJ 11 or RJ45 plugs are both used for communication devices and respectively have a dimension different from the other. Because the RJ 11 plug has a smaller dimension than that of the RJ 45 plug, the RJ 11 plug may be erroneously inserted into the modular socket (namely the RJ 45 socket) configured to mate for the RJ 45 plug and thus leads on the RJ 45 modular socket may be damaged.

To overcome the shortcomings, the present invention tends to provide an improved modular socket having an errorproof device therein to mitigate the aforementioned problems.

SUMMARY OF THE INVENTION

The primary objective of the present invention is to provide an improved modular socket having an errorproof device inserted into the modular socket to prevent erroneous insertion of a modular plug with an inappropriate dimension when compared with the dimension of the modular socket.

Another objective of the present invention is that a recovery force providing device is provided to the errorproof device to return the errorproof device to its original position after the errorproof device has been moved.

Other objects, advantages and novel features of the invention will become more apparent from the following detailed description when taken in conjunction with the accompanying drawings.

DETAILED DESCRIPTION OF THE PREFERRED EMBODIMENT

Figure 1:
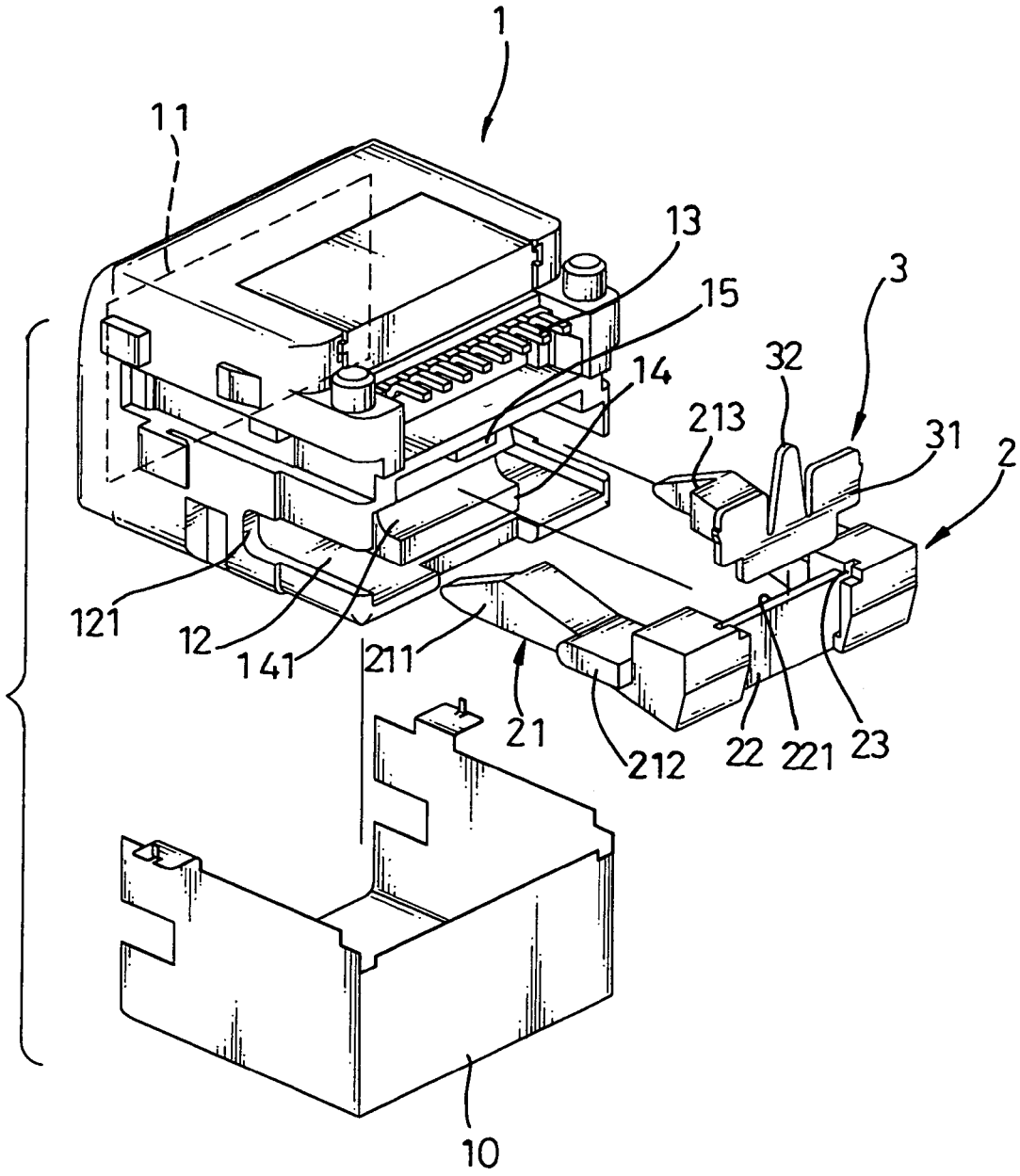
FIG. 1 is an exploded perspective view of the modular socket in accordance with the present invention.

With reference to FIG. 1, it is noted that the modular socket of the present invention includes a body (1), a errorproof device (2) and a recovery force providing device (3).

The body (1) includes a through hole (11) defined in one end of the body (1), two opposed slots (12) respectively defined in a side face of the body (1) to communicate with the through hole (11) of the body (1), a stop (121) formed with the body (1) and on a mediate portion of the slot (12), multiple first leads (13) formed inside the body (1) to be connected to second leads on a modular plug (not shown in this drawing) and extending to the other end of the body (1) and an engaging seat (14) oppositely formed with the body (1) relative to the through hole (11) and having a first arcuate face (141) formed on an outer face of the engaging seat (14). Furthermore, the modular socket of the present invention has a casing (10) to be mounted outside the body (1) via a suitable and appropriate method well known in the art.

The errorproof device (2) has two arms (21) respectively corresponding to and received in one of the two slots (12) of the body (1) and a bridge (22) extending between and connecting the two arms (21), the bridge (22) having a second arcuate face (221) formed to correspond to the first arcuate face (141). Each arm (21) has a wedge head (211) so as to have an inclined top face relative to a bottom face. A gap (23) is defined at a joint between the bridge (22) and the arm (21) so that a receiving space is defined between the arms (21) and the bridge (22). Furthermore, each arm (21) is provided with a boss (212) formed on an outer face of the arm (21) to correspond to the stop (121) of the body (1) and a step (213) formed on an inner face of the arm (21).

The recovery force providing device (3) has two extensions (31) respectively and oppositely extending in different directions relative to one another and an engaging finger (32) extending between the two extensions (31) to correspond to an engaging plate (15) which is formed on top of the engaging seat (14) of the body (1).

Figure 2:
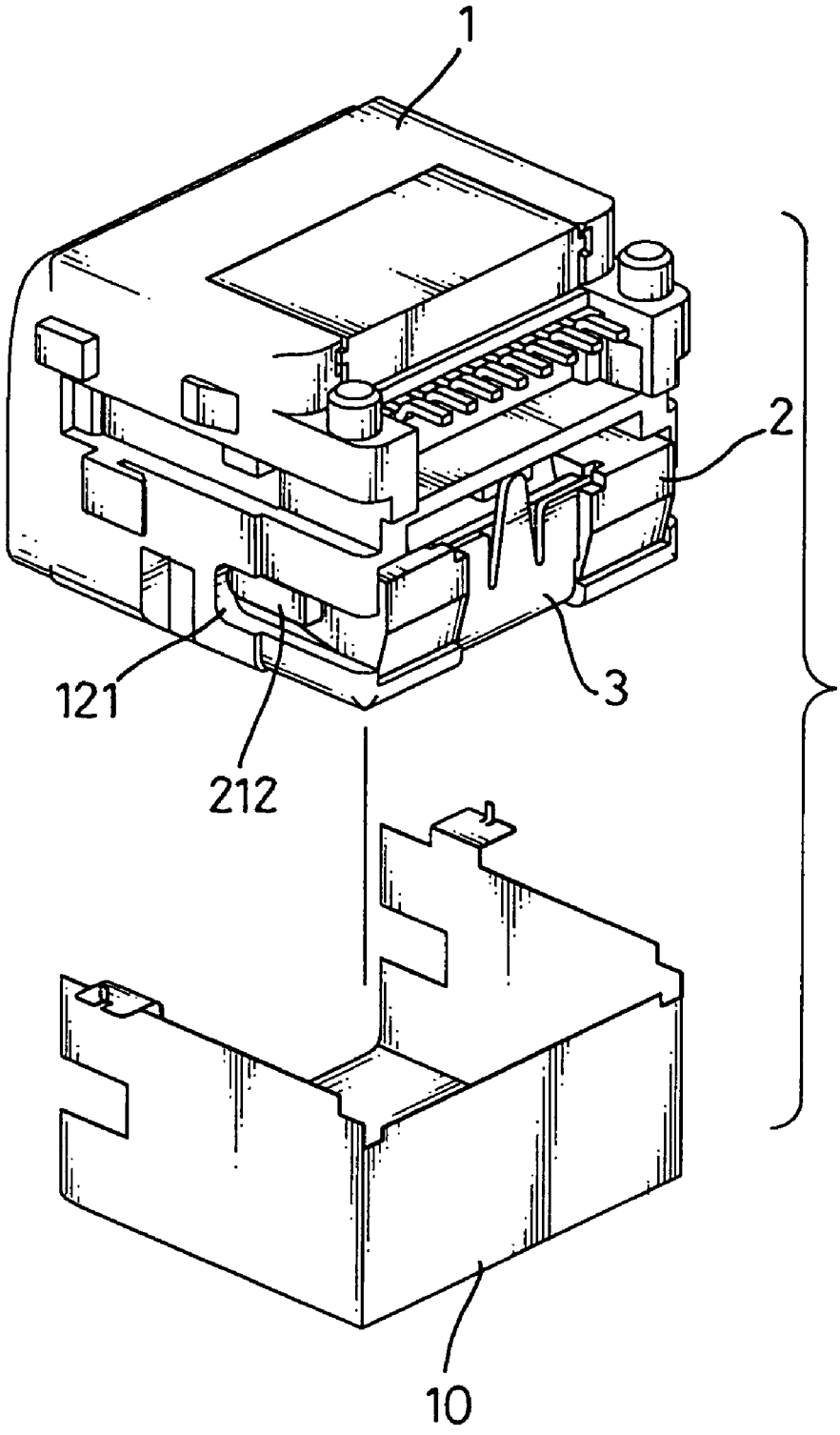
FIG. 2 is an exploded perspective view of the modular socket with the errorproof device together with the recovery force providing device inserted into the body.
Figure 3:
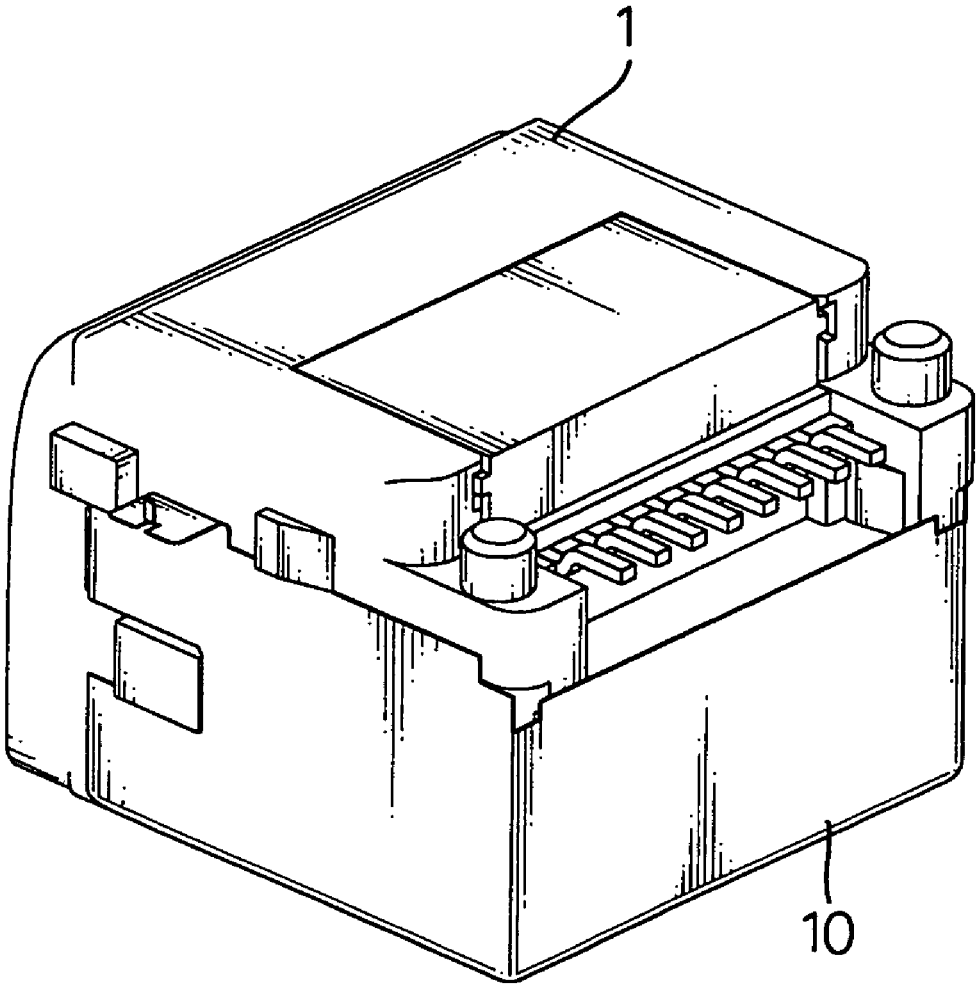
FIG. 3 is a perspective view showing the assembly of the modular socket of the present invention.

With reference to FIGS. 2 and 3, it is noted that when the modular socket of the present invention is in assembly, after the recovery force providing device (3) is inserted into the gap (23) between the bridge (22) and the two arms (21), the two arms (21) of the errorproof device (2) are inserted into the two corresponding slots (12) with the first arcuate face (141) engaging the second arcuate face (221). Engagement between the stop (121) of the body (1) and the boss (212) of the errorproof device (2) ensures that there is no excessive extension of the errorproof device (2) into the body (1). Then the casing (10) is mounted on the body (1) to enclose the errorproof device (2) as well as the recovery force providing device (3) inside the body (1) so that escape of the errorproof device (2) from the body (1) is avoided, as is escape of the recovery force providing device (3) from the body (1). As the mounting of the casing (10) to the body (1) is well known in the art, detailed description thereof is omitted for brevity.

Figure 5:
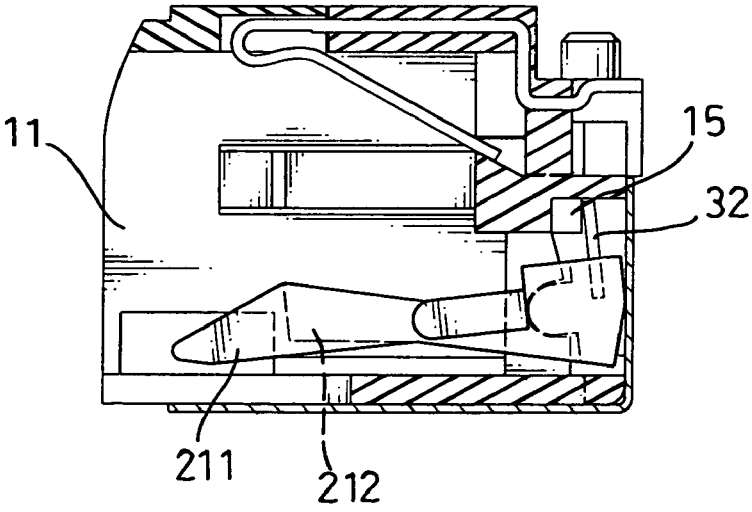
FIG. 5 is a schematic cross sectional view showing that after the modular plug is removed from the modular socket, the recovery force providing device returns the errorproof device to its original position in the modular socket.

With reference to FIG. 5, before the insertion of a modular plug into the through hole (11) of the body (1), the engaging finger (32) engages with the engaging plate (15) of the body (1) and the wedge head (211) is inserted into the corresponding slot (12).

Figure 4:
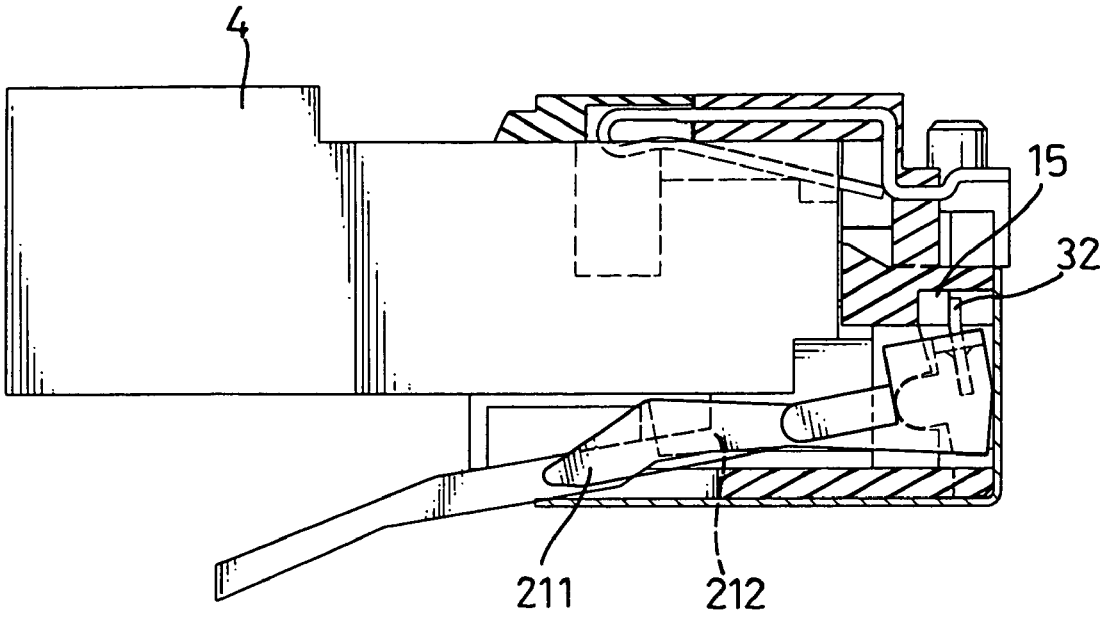
FIG. 4 is a schematic cross sectional view showing that a modular plug is inserted into the modular socket and the errorproof device is pivoted.

Then with reference to FIG. 4, while the modular plug (4) is being inserted into the through hole (11) of the body (1), a bottom end of the modular plug (4) engages with the inclined top face of the wedge head (211) of the arm (21) so as to force the errorproof device (2) to pivot inside the slot (12) via the engagement between the first arcuate face (141) and the second arcuate face (221). After the errorproof device (2) is pivoted, the engaging finger (32) is deformed due to the engagement with the engaging plate (15) and the two arms (21) are pressed downward inside the slots (12) by the bottom end of the modular plug (4).

Furthermore, the two steps (213) of the two arms (21) are able to prevent erroneous extension of a modular plug with an inappropriate dimension. Because the distance between the two steps (213) is smaller than a distance between two distal ends of the arms (21), insertion of a modular plug having a dimension smaller than the distance between the two distal ends of the arms (21) is stopped by the two steps (213).

When the modular plug (4) is removed from the modular socket of the present invention, the engaging finger (32) returns to its original shape due to the resilient force stored therein. Thus the errorproof device (2) is pivoted again to its original position and the two arms (21) are also driven to return to the position as shown in FIG. 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A modular socket for use with a modular plug, the modular socket comprising:

a body having a through hole defined in the body for receiving a modular plug and two opposed slots each defined in a side face of the body;

an errorproof device pivotally received in the body and having two arms respectively extending out to be inserted into a correspondence one of the two slots, each arm having a wedge head formed on a distal end of the arm and an inclined face formed on top of the wedge head relative to a bottom face of the wedge head and a step formed on an inner face of each arm for prevention of an erroneous insertion of the modular plug of a dimension smaller than a distance between the two arms;

a recovery force providing device securely engaged with the errorproof device to provide a recovery force to the errorproof device when the errorproof device is pivoted; and a casing securely mounted outside the body to prevent separation of the errorproof device and the recovery force providing device from the body.

2. The modular socket as claimed in claim 1, wherein the body further has an engaging seat formed on the body and having a first arcuate face formed on the engaging seat and the errorproof device has a bridge formed between the two arms to securely connect the two arms and having a second arcuate face formed to correspond to and engage with the first arcuate face such that after the second arcuate face is received in the first arcuate face, the errorproof device is able to pivot relative to the body.

3. The modular socket as claimed in claim 2, wherein a gap is defined at a joint between the bridge and each of the two arms so as to define a receiving space to receive therein the recovery force providing device.

4. The modular socket as claimed in claim 1, wherein the body further has an engaging plate formed on the body and the recovery force providing device has an engaging finger extending out to engage with the engaging plate such that when the errorproof device is pivoted relative to the body, engagement between the engaging plate and the engaging finger deforms the engaging finger and thus a recovery force is stored inside the recovery force providing device.

5. The modular socket as claimed in claim 4, wherein the body further has a stop formed on the body and on a mediate portion of the slot, the errorproof device has a boss formed on an outer face of the arm to engage with the stop so as to prevent excessive extension of the two arms into the two slots.

6. The modular socket as claimed in claim 2, wherein the body further has an engaging plate formed on the body and the recovery force providing device has an engaging finger extending out to engage with the engaging plate such that when the errorproof device is pivoted relative to the body, engagement between the engaging plate and the engaging finger deforms the engaging finger and thus a recovery force is stored inside the recovery force providing device.

7. The modular socket as claimed in claim 6, wherein the body further has a stop formed on the body and on a mediate portion of the slot, the errorproof device has a boss formed on an outer face of the arm to engage with the stop so as to prevent excessive extension of the two arms into the two slots.

8. The modular socket as claimed in claim 3, wherein the body further has an engaging plate formed on the body and the recovery force providing device has an engaging finger extending out to engage with the engaging plate such that when the errorproof device is pivoted relative to the body, engagement between the engaging plate and the engaging finger deforms the engaging finger and thus a recovery force is stored inside the recovery force providing device.

9. The modular socket as claimed in claim 8, wherein the body further has a stop formed on the body and on a mediate portion of the slot, the errorproof device has a boss formed on an outer face of the arm to engage with the stop so as to prevent excessive extension of the two arms into the two slots.

* * * * *